US012082710B2

(12) United States Patent
Reinhart

(10) Patent No.: US 12,082,710 B2
(45) Date of Patent: Sep. 10, 2024

(54) ARTICLE OF OUTDOOR FURNITURE WITH CUPHOLDER

(71) Applicant: NICKOLAS BRANDS, LLC, Findlay, OH (US)

(72) Inventor: Nickolas Reinhart, Sarasota, FL (US)

(73) Assignee: FINDLAY MACHINE & TOOL, LLC, Findlay, OH (US)

( * ) Notice: Subject to any disclaimer, the term of this patent is extended or adjusted under 35 U.S.C. 154(b) by 50 days.

(21) Appl. No.: 17/883,839

(22) Filed: Aug. 9, 2022

(65) Prior Publication Data

US 2023/0046883 A1 Feb. 16, 2023

Related U.S. Application Data

(60) Provisional application No. 63/231,301, filed on Aug. 10, 2021.

(51) Int. Cl.

| | |
|---|---|
| ***A47C 1/14*** | (2006.01) |
| ***A47C 3/04*** | (2006.01) |
| ***A47C 7/62*** | (2006.01) |

(52) U.S. Cl.

CPC ..... *A47C 7/622* (2018.08); *A47C 1/14* (2013.01); *A47C 3/04* (2013.01); *A47C 7/624* (2018.08)

(58) Field of Classification Search

CPC .. A47C 1/14; A47C 7/622; A47C 3/04; A47C 7/624

USPC ..... 297/188.14, 452.63, 239

See application file for complete search history.

(56) References Cited

U.S. PATENT DOCUMENTS

| | | | | | |
|---|---|---|---|---|---|
| D109,239 | S * | 4/1938 | Wolpin | D6/370 | |
| 2,118,676 | A * | 5/1938 | Lankton | A47C 3/025 | 297/452.63 X |
| 2,490,884 | A * | 12/1949 | Rau | A47C 4/027 | 297/440.13 |
| 2,650,652 | A * | 9/1953 | Watson | A47C 4/14 | 297/31 |
| 4,635,998 | A * | 1/1987 | Hickey | A47C 4/08 | 297/39 |
| 4,707,023 | A * | 11/1987 | Hickey | A47C 4/08 | 297/39 |
| 4,976,492 | A * | 12/1990 | Ziegler | A47C 4/14 | 297/39 |
| 5,745,565 | A * | 4/1998 | Wakefield | B60N 3/103 | 379/426 |
| 5,911,469 | A * | 6/1999 | Young | A47C 7/54 | 297/39 |
| 5,938,091 | A * | 8/1999 | Bergin | B62B 3/1472 | 224/526 |
| D478,741 | S * | 8/2003 | White | D19/77 | |
| 6,811,226 | B1 * | 11/2004 | Kamrath | A47C 11/00 | 297/440.16 |
| D516,393 | S * | 3/2006 | Wickenhauser | D7/701 | |
| 7,099,467 | B1 * | 8/2006 | Rohrbach | G09B 15/00 | 379/446 |

(Continued)

*Primary Examiner* — Rodney B White

(74) *Attorney, Agent, or Firm* — Jacob M. Ward; Ward Law Office LLC

(57) ABSTRACT

An outdoor chair is provided that includes a seat, a pair of front legs, a pair of rear legs, a backrest, a pair of armrests, and a recess in at least one of the armrests. The recess includes a first recess and a second recess. The first recess is configured to accept a beverage container. The second recess is configured to accept a mobile device.

18 Claims, 7 Drawing Sheets

(56) References Cited

U.S. PATENT DOCUMENTS

RE39,392 E * 11/2006 Bergin ..... A47C 7/62 297/188.14 X
D546,823 S * 7/2007 Dayan ..... D14/253
D570,127 S * 6/2008 Spink ..... D6/370
8,172,316 B2 * 5/2012 Gamboa ..... A47C 3/04 297/239 X
8,172,317 B2 * 5/2012 Gamboa ..... A47C 7/68 297/239 X
8,182,031 B1 * 5/2012 MacKenzie ..... A47C 4/10 297/188.14 X
8,191,963 B2 * 6/2012 Gamboa ..... A47C 7/68 297/239 X
8,333,430 B2 * 12/2012 Adams ..... A47C 7/462 297/452.63 X
8,528,979 B2 * 9/2013 College ..... F16B 12/26 297/452.63 X
D777,465 S * 1/2017 Milde ..... D6/370
9,532,654 B1 * 1/2017 Adams, IV ..... A47C 7/68
D787,848 S * 5/2017 Adams, IV ..... D6/370
9,675,176 B2 * 6/2017 Adams, IV ..... B29C 45/16
D820,050 S * 6/2018 Bergin ..... D7/620
10,005,404 B2 * 6/2018 Lupsan ..... B60N 3/101
D826,658 S * 8/2018 Bergin ..... D7/701
D853,142 S * 7/2019 Tao ..... D6/370
10,722,037 B2 * 7/2020 Pendleton, Jr. ..... A47C 7/624
11,064,810 B2 * 7/2021 Snir ..... A47C 7/622
D995,135 S * 8/2023 Zhaowen ..... D6/370
2004/0086112 A1 * 5/2004 Hilger ..... B60R 11/0241 379/455
2005/0200167 A1 * 9/2005 Bollenbach ..... A47C 1/14 297/181
2006/0163920 A1 * 7/2006 Adams ..... A47C 1/0265 297/239
2011/0266843 A1 * 11/2011 Gamboa ..... A47C 7/54 297/188.14
2015/0327675 A1 * 11/2015 Fenner ..... A47B 83/02 297/188.14 X
2016/0220027 A1 * 8/2016 Milde ..... A47C 1/14
2018/0035817 A1 * 2/2018 Wheat ..... A47C 21/00
2019/0145153 A1 * 5/2019 Edelman ..... A47C 1/143 297/188.01
2019/0357688 A1 * 11/2019 Dobson ..... A47C 7/624
2021/0401164 A1 * 12/2021 Cass ..... H02J 7/0044
2022/0330701 A1 * 10/2022 Goodworth ..... A47C 3/04
2023/0165371 A1 * 6/2023 Reinhart ..... A47C 7/624 297/239
2023/0200544 A1 * 6/2023 Reinhart ..... A47C 11/005 297/232

* cited by examiner

ARTICLE OF OUTDOOR FURNITURE WITH CUPHOLDER

CROSS-REFERENCE TO RELATED APPLICATIONS

This application claims the benefit of U.S. Provisional Application No. 63/231,301, filed on Aug. 10, 2021. The entire disclosure of the above application is incorporated herein by reference.

FIELD

The disclosure generally relates to articles of outdoor furniture and, more particularly, to outdoor chairs.

INTRODUCTION

This section provides background information related to the present disclosure which is not necessarily prior art.

Adirondack chairs are a very popular larger type of chair. For many years, these chairs were made of wood with the pieces of the chair nailed, glued, bolted, or screwed together to form a single unit. The Adirondack chair style typically has a straight back that is formed by multiple wooden planks that extend from a seat at an angle. Most wooden Adirondack chairs are not foldable. They are also heavy and very difficult to stack.

More recently, some Adirondack chairs have been made of plastic. These chairs are molded to look like the wooden Adirondack chairs. Such molded plastic chairs are lighter and may be more weather resistant than their wooden predecessors. Further, the molded plastic chairs may be stored more efficiently since the molded plastic chairs may often be stacked on top of one another.

However, the designs of currently available molded plastic chairs lack certain accommodations to enhance the enjoyment and use of the chairs. For instance, the currently available molded plastic chairs are unaccommodating for users that are using hand-held objects, such as a beverage and/or a mobile device. These hand-held objects are frequently engaged by users in an outdoor setting where the currently available molded plastic chairs are commonly used. For example, molded plastic chairs are often used at social settings where beverages are consumed. Many currently available molded plastic chairs do not include any features to support beverage containers. This lack of support causes the beverage containers to be prone to spilling when set down next to the chair or on a flat arm rest of the chair.

Accordingly, there is a need for an improved outdoor chair that adequately supports one or more hand-held objects and may be manufactured more economically.

SUMMARY

In concordance with the instant disclosure, an improved outdoor chair that adequately supports one or more hand-held objects and may be manufactured more economically, has been surprisingly discovered.

An article of outdoor furniture, which has a unitary body, is provided. The article of outdoor furniture includes a first recess formed in the unitary body. The first recess has a first opening and a first bottom wall. A surface area of the first opening is greater than a surface area of the first bottom wall. An article of outdoor has a second recess formed in the unitary body. The second recess has a second opening and a second bottom wall. The second opening has a first length and a first width, where the first length is greater than the first width.

A method of using an article of outdoor furniture includes providing an article of outdoor furniture and placing one of a beverage container in the first recess and a mobile device in the second recess.

Further areas of applicability will become apparent from the description provided herein. The description and specific examples in this summary are intended for purposes of illustration only and are not intended to limit the scope of the present disclosure.

DRAWINGS

The drawings described herein are for illustrative purposes only of selected embodiments and not all possible implementations, and are not intended to limit the scope of the present disclosure.

DETAILED DESCRIPTION

Figure 1:
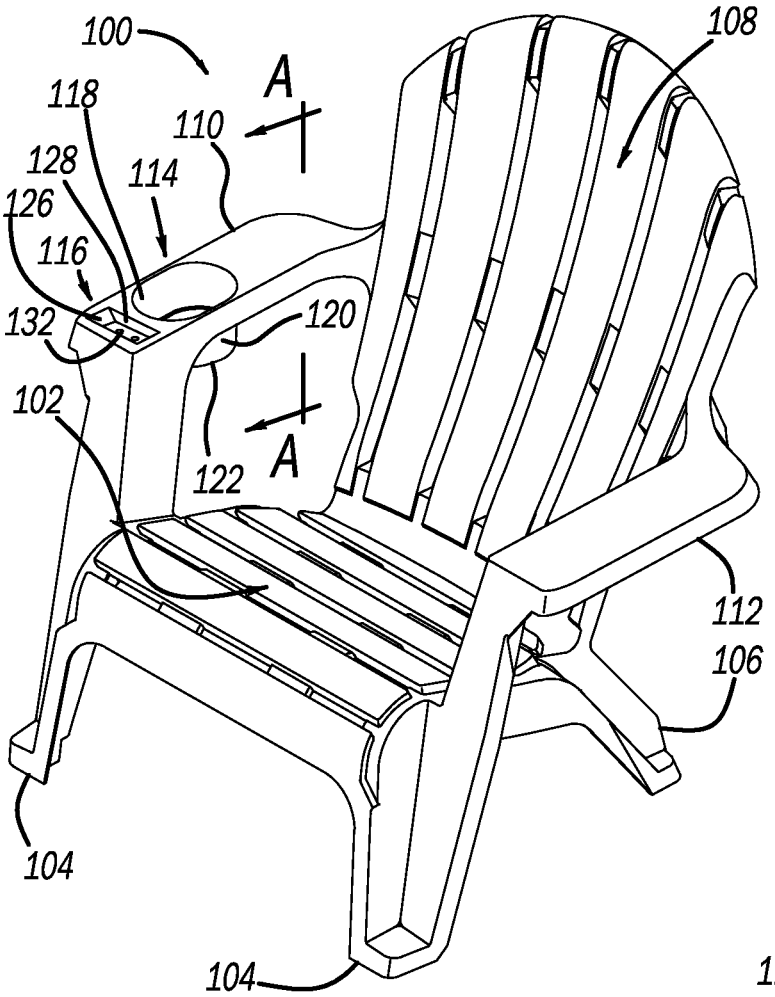
FIG. 1 is a top perspective view of an article of outdoor furniture configured as an Adirondack outdoor chair, where the outdoor chair has a first recess and a second recess in an armrest thereof, according to an embodiment of the present disclosure.
Figure 2:
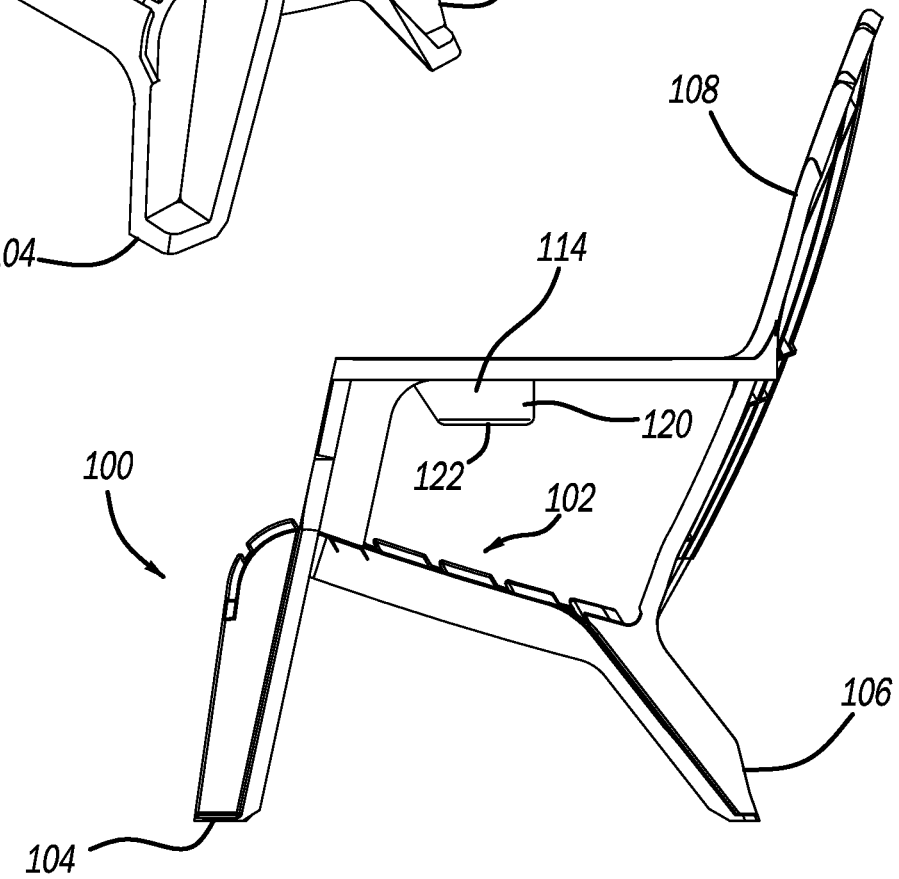
FIG. 2 is a right side elevational view of the outdoor chair.
Figure 3:
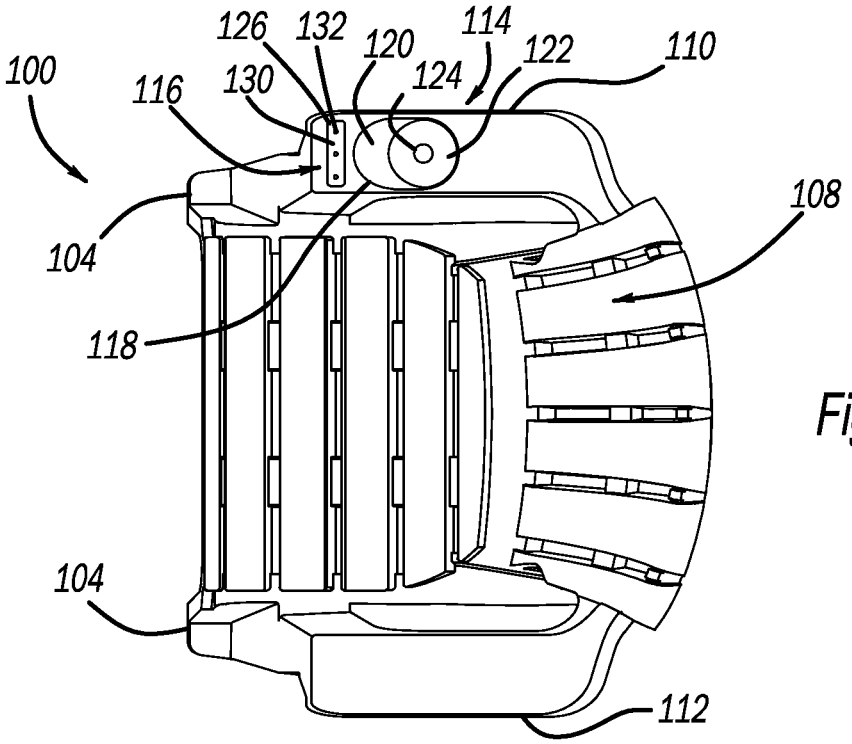
FIG. 3 is a top plan view of the outdoor chair.
Figure 4:
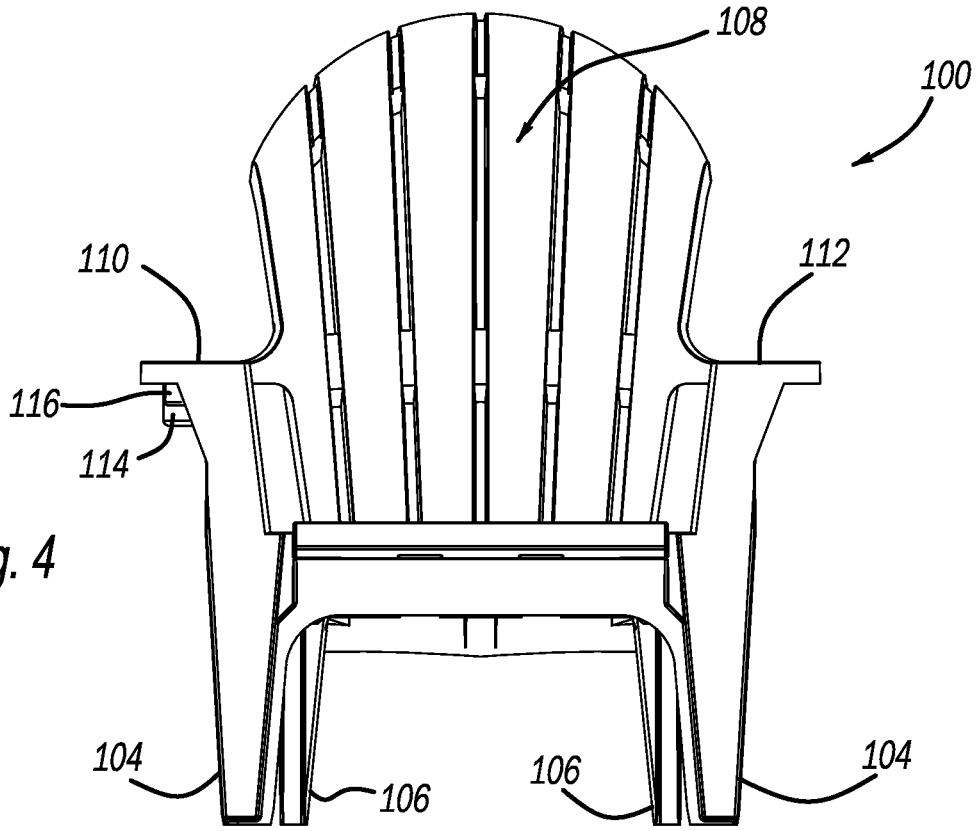
FIG. 4 is a front elevational view of the outdoor chair.
Figure 5:
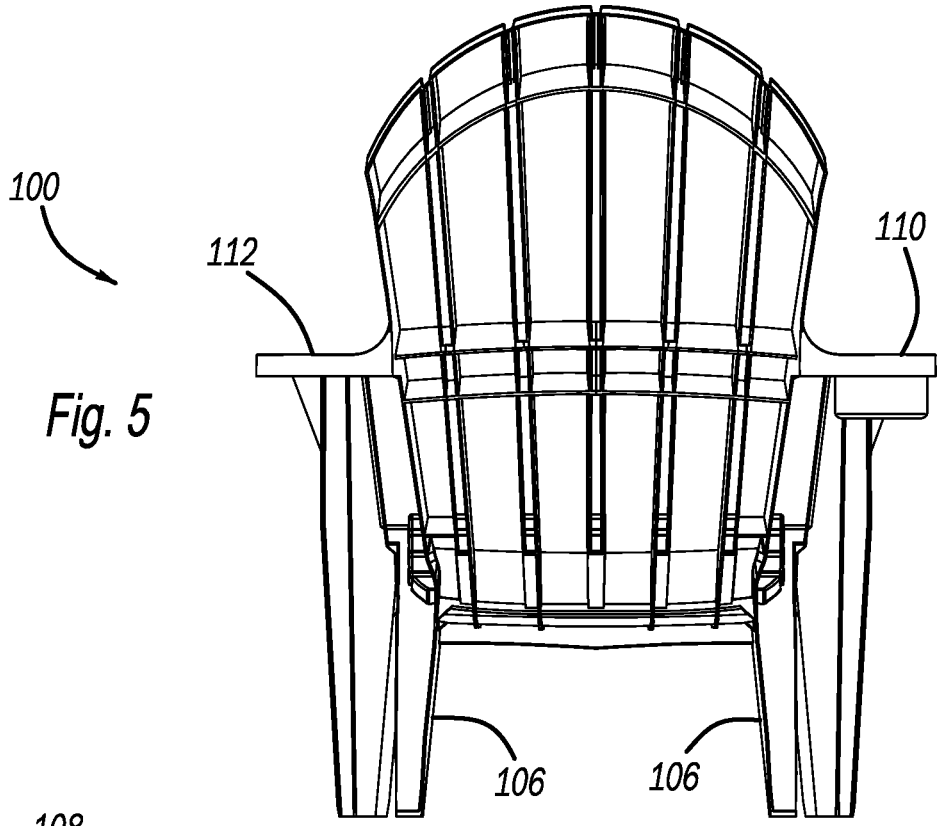
FIG. 5 is a rear elevational view of the outdoor chair.
Figure 6:
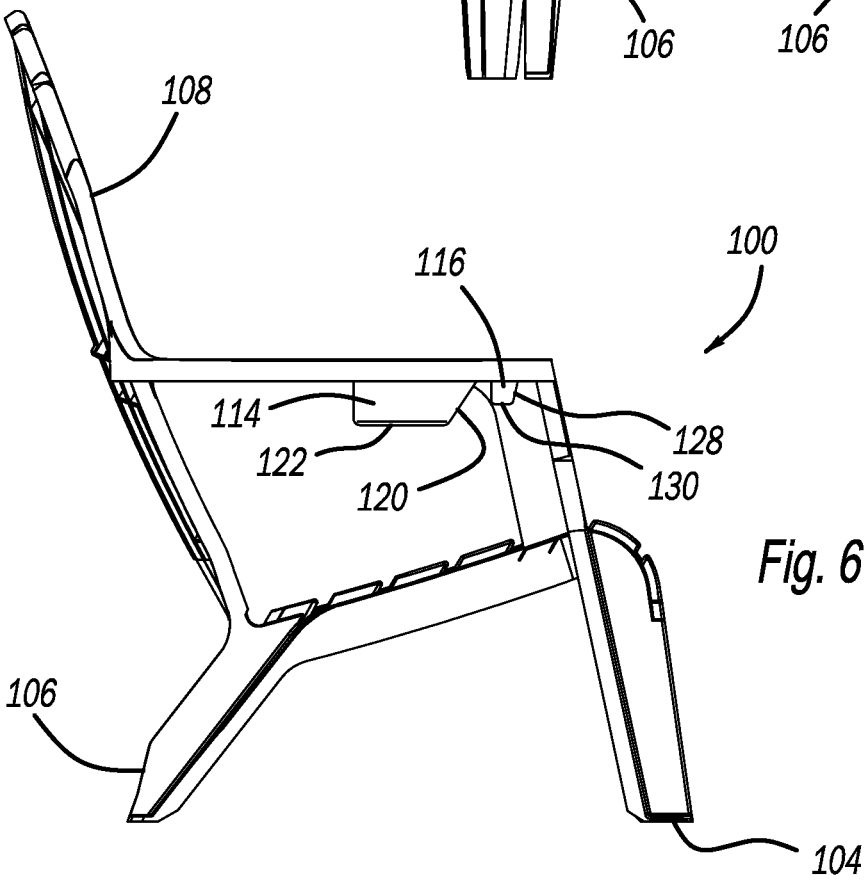
FIG. 6 is a left side elevational view of the outdoor chair.
Figure 7:
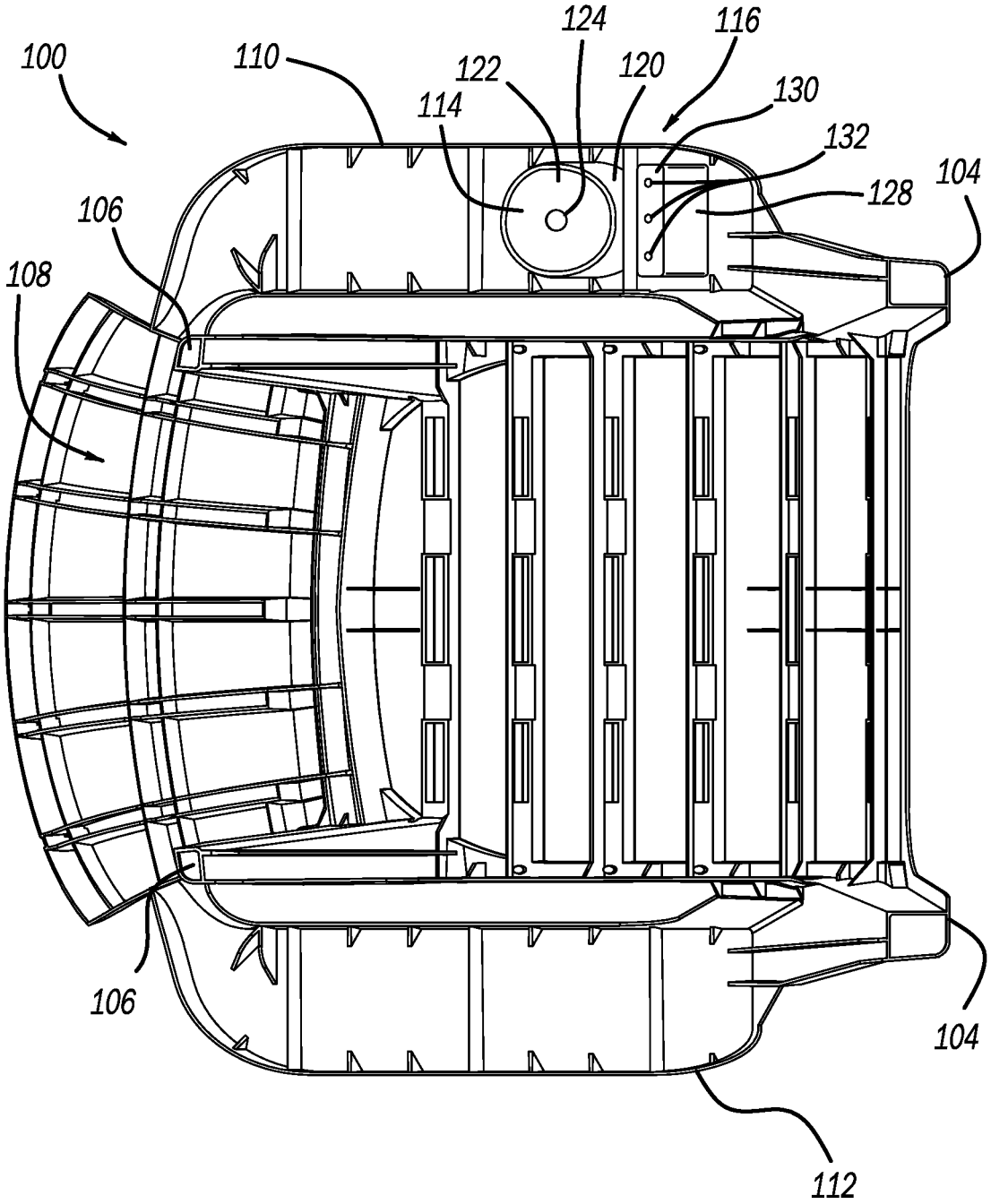
FIG. 7 is a bottom plan view of the outdoor chair.

The following description of technology is merely exemplary in nature of the subject matter, manufacture and use of one or more inventions, and is not intended to limit the scope, application, or uses of any specific invention claimed in this application or in such other applications as may be filed claiming priority to this application, or patents issuing therefrom. Regarding methods disclosed, the order of the steps presented is exemplary in nature, and thus, the order of the steps can be different in various embodiments, including where certain steps can be simultaneously performed. "A" and "an" as used herein indicate "at least one" of the item is present; a plurality of such items may be present, when possible. Except where otherwise expressly indicated, all numerical quantities in this description are to be understood as modified by the word "about" and all geometric and spatial descriptors are to be understood as modified by the word "substantially" in describing the broadest scope of the technology. "About" when applied to numerical values indicates that the calculation or the measurement allows some slight imprecision in the value (with some approach to exactness in the value; approximately or reasonably close to the value; nearly). If, for some reason, the imprecision provided by "about" and/or "substantially" is not otherwise understood in the art with this ordinary meaning, then "about" and/or "substantially" as used herein indicates at least variations that may arise from ordinary methods of measuring or using such parameters.

Although the open-ended term "comprising," as a synonym of non-restrictive terms such as including, containing, or having, is used herein to describe and claim embodiments of the present technology, embodiments may alternatively be described using more limiting terms such as "consisting of" or "consisting essentially of." Thus, for any given embodiment reciting materials, components, or process steps, the present technology also specifically includes embodiments consisting of, or consisting essentially of, such materials, components, or process steps excluding additional materials, components or processes (for consisting of) and excluding additional materials, components or processes affecting the significant properties of the embodiment (for consisting essentially of), even though such additional materials, components or processes are not explicitly recited in this application. For example, recitation of a composition or process reciting elements A, B and C specifically envisions embodiments consisting of, and consisting essentially of, A, B and C, excluding an element D that may be recited in the art, even though element D is not explicitly described as being excluded herein.

As referred to herein, disclosures of ranges are, unless specified otherwise, inclusive of endpoints and include all distinct values and further divided ranges within the entire range. Thus, for example, a range of "from A to B" or "from about A to about B" is inclusive of A and of B. Disclosure of values and ranges of values for specific parameters (such as amounts, weight percentages, etc.) are not exclusive of other values and ranges of values useful herein. It is envisioned that two or more specific exemplified values for a given parameter may define endpoints for a range of values that may be claimed for the parameter. For example, if Parameter X is exemplified herein to have value A and also exemplified to have value Z, it is envisioned that Parameter X may have a range of values from about A to about Z. Similarly, it is envisioned that disclosure of two or more ranges of values for a parameter (whether such ranges are nested, overlapping, or distinct) subsume all possible combination of ranges for the value that might be claimed using endpoints of the disclosed ranges. For example, if Parameter X is exemplified herein to have values in the range of 1-10, or 2-9, or 3-8, it is also envisioned that Parameter X may have other ranges of values including 1-9, 1-8, 1-3, 1-2, 2-10, 2-8, 2-3, 3-10, 3-9, and so on.

When an element or layer is referred to as being "on," "engaged to," "connected to," or "coupled to" another element or layer, it may be directly on, engaged, connected, or coupled to the other element or layer, or intervening elements or layers may be present. In contrast, when an element is referred to as being "directly on," "directly engaged to," "directly connected to" or "directly coupled to" another element or layer, there may be no intervening elements or layers present. Other words used to describe the relationship between elements should be interpreted in a like fashion (e.g., "between" versus "directly between," "adjacent" versus "directly adjacent," etc.). As used herein, the term "and/or" includes any and all combinations of one or more of the associated listed items.

Although the terms first, second, third, etc. may be used herein to describe various elements, components, regions, layers and/or sections, these elements, components, regions, layers and/or sections should not be limited by these terms. These terms may be only used to distinguish one element, component, region, layer or section from another region, layer, or section. Terms such as "first," "second," and other numerical terms when used herein do not imply a sequence or order unless clearly indicated by the context. Thus, a first element, component, region, layer, or section discussed below could be termed a second element, component, region, layer, or section without departing from the teachings of the example embodiments.

Spatially relative terms, such as "inner," "outer," "beneath," "below," "lower," "above," "upper," and the like, may be used herein for ease of description to describe one element or feature's relationship to another element(s) or feature(s) as illustrated in the figures. Spatially relative terms may be intended to encompass different orientations of the device in use or operation in addition to the orientation depicted in the figures. For example, if the device in the FIGS. is turned over, elements described as "below" or "beneath" other elements or features would then be oriented "above" the other elements or features. Thus, the example term "below" can encompass both an orientation of above and below. The device may be otherwise oriented (rotated 90 degrees or at other orientations) and the spatially relative descriptors used herein interpreted accordingly.

As shown in FIGS. 1-9, an article of outdoor furniture is provided, where the embodiment depicted is configured as an outdoor chair 100 resembling an Adirondack chair. The outdoor chair 100 may include a seat 102, a pair of front legs 104, a pair of rear legs 106, a backrest 108, a first armrest 110, a second armrest 112, a first recess 114, and a second recess 116. The first armrest 110 and second armrest 112 may be coupled to the front legs 104 and the backrest 108. Each of the components including the seat 102, a pair of front legs 104, a pair of rear legs 106, a backrest 108, a first armrest 110, a second armrest 112, a first recess 114, and a second recess 116, can be connected to adjacent components, forming a unitary body. In a specific example, the article of outdoor furniture may be contiguous and form the unitary body with all parts of the article of outdoor furniture sharing an uninterrupted surface. In a more specific example, the article of outdoor furniture may be injection molded, producing one continuous body that having each of the components formed of the same material. For example, the article of outdoor furniture may be injection molded and formed by a single piece of plastic or metal, allowing the various portions of the article of outdoor furniture to be formed without assembling separate components, including where separate components are coupled using fasteners. The first recess 114 may be configured to accept a beverage container. The second recess 116 may be configured to accept a mobile device, such as a smart phone. One skilled in the art may select other suitable objects to support with the first recess 114 and/or the second recess 116, within the scope of the present disclosure.

In certain embodiments, the first recess 114 and the second recess 116 may be disposed on the same armrest, for instance, such as where the first recess 114 and the second recess 116 are disposed on the first armrest 110, as shown in FIGS. 1, 3-4, and 6-9. It is also contemplated that the first recess 114 and the second recess 116 may be disposed on separate armrests. For instance, the first recess 114 may be disposed on the first armrest 110 and the second recess 116 may be disposed on the second armrest 112, and vice versa. One skilled in the art may select other suitable locations and positions to dispose the first recess 114 and the second recess 116, within the scope of the present disclosure.

As illustrated in FIGS. 1-3 and 6-9, the first recess 114 may be configured to accept a beverage container. For instance, the first recess 114 may include a first opening 118, a first sidewall 120, and a first bottom wall 122. The first bottom wall 122 may be substantially circular or ovoid. The first bottom wall 122 may be particularly sized and shaped to accommodate and support beverage containers of various sizes. To this end, it should be appreciated that the first bottom wall 122 may be shaped to form a variety of suitable shapes known to those of skill in the art. The first bottom wall 122 may include a drain hole 124 disposed therethrough. In a specific, non-limiting example, the first opening 118 may be substantially oval-shaped. Substantially oval-shaped encompasses shapes that are elliptical and/or form an ellipse shape, for example, an ovoid. The first bottom wall 122 may have a first surface area. The first opening 118 may have a second surface area. The second surface area of the first opening 118 may be greater than the first surface area of the first bottom wall 122.

Figure 8:
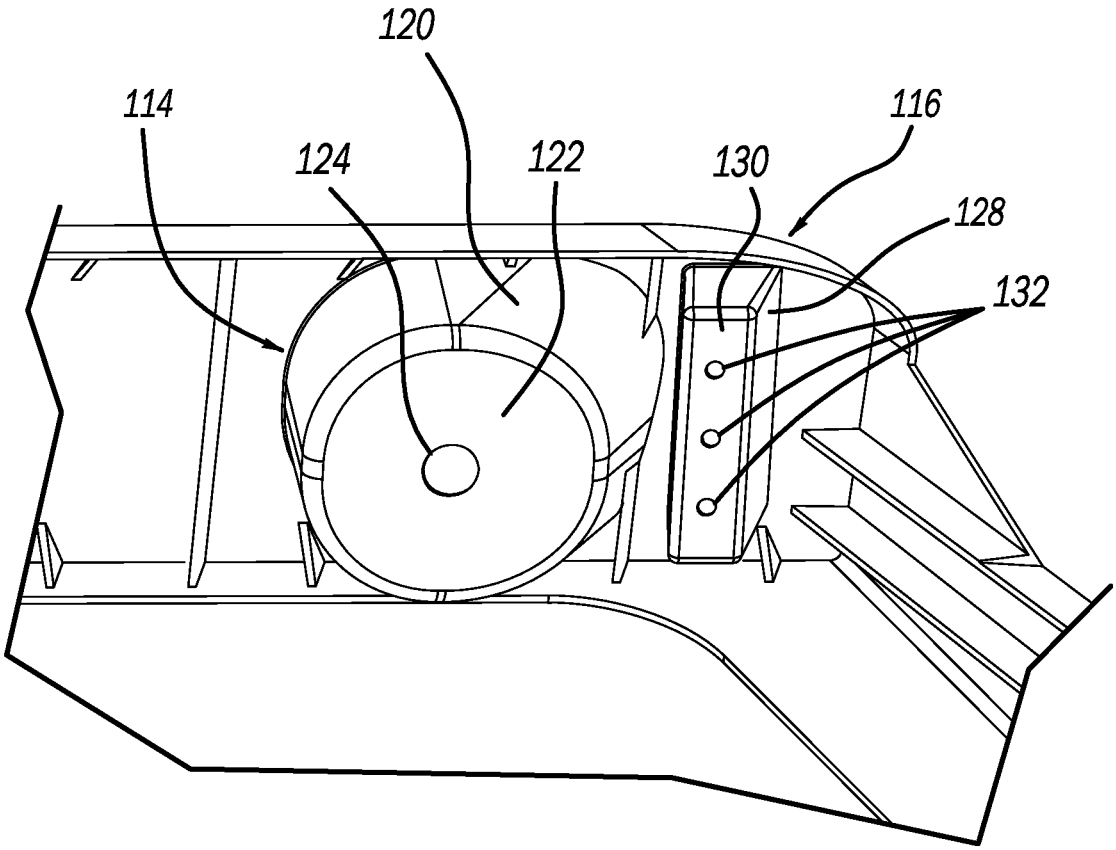
FIG. 8 is an enlarged bottom perspective view of a portion of the armrest of the outdoor chair showing the underside of the first recess and the second recess.

Advantageously, the second surface area of the first opening 118 may be greater than the first surface area of the first bottom wall 122 to allow the first recess 114 to be more easily molded and more economically manufactured. Further, the beverage container may be more easily disposed into and/or removed from the first recess 114 where the second surface area of the first opening 118 is greater than the first surface area of the first bottom wall 122. Where the second surface area of the first opening 118 is greater than the first surface area of the bottom wall, a portion of the first sidewall 120 connecting the first bottom wall 122 to the first opening 118 may be partially angled relative to a remainder of the first sidewall 120. As shown in FIG. 8, the first bottom wall 112 and the first sidewall 120 may be joined together by a beveled surface which may assist in molding, manufacturing, and directing liquids toward the drain hole 124, allowing liquid to drain from the first recess 114.

Figure 9:
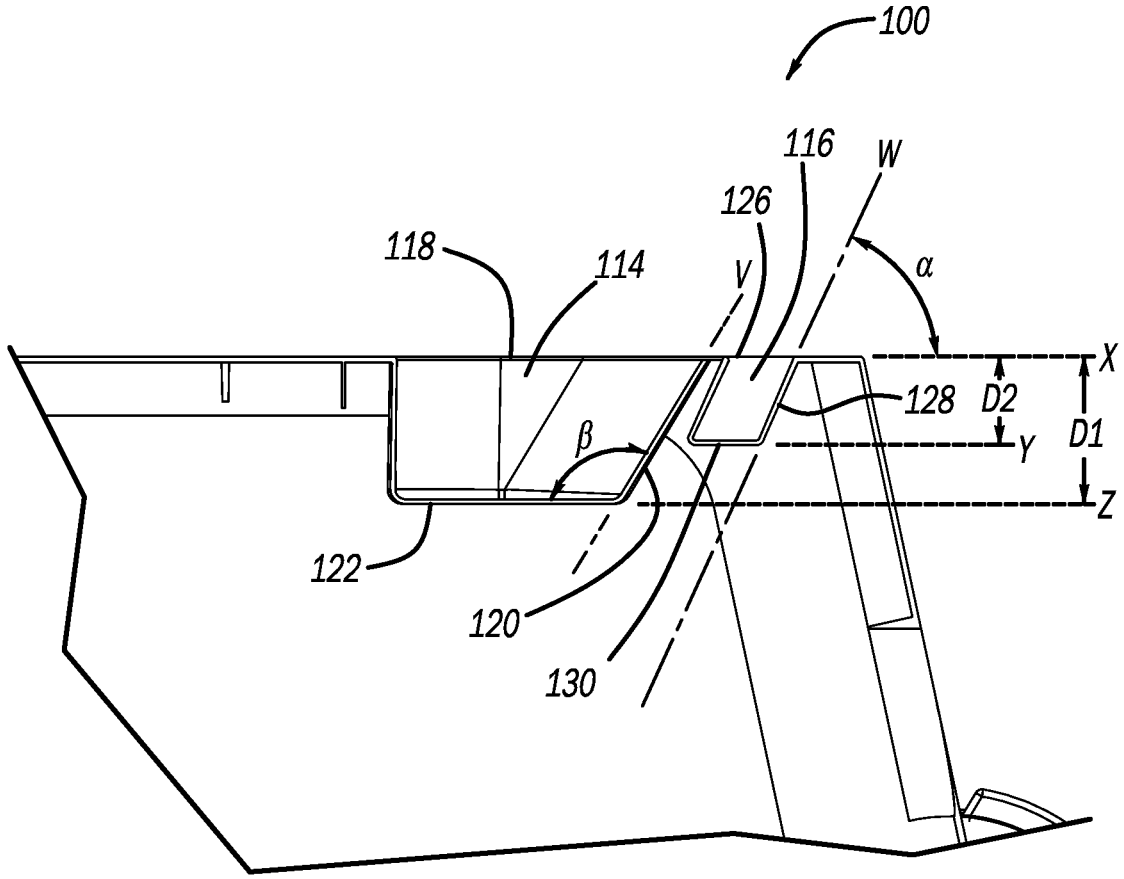
FIG. 9 is an enlarged cross-sectional view of the portion of the armrest of the outdoor chair taken at A-A in FIG. 1.

Desirably, an angled portion of the first sidewall 120 connecting the first bottom wall 122 to the first opening 118 may direct accumulated condensation and/or other liquids toward the drain hole 124 of the first bottom wall 122. As illustrated in FIG. 9, the angled portion of the first sidewall 120 may intersect with the first bottom wall 122, resulting in an angle β. The angle β allows for optimal drainage of the first recess 114. The angle β may further cooperate with the beveled surface between the first bottom wall 112 and the first sidewall 120 to promote efficient drainage. As shown in FIG. 9, in certain embodiments, the beveled surface connecting the first bottom wall 112 and the first sidewall 120 may have a steeper slope and/or a higher vertical height on portions further from the angled portion of the first sidewall 120.

Furthermore, the angled portion of the first sidewall 120 may accommodate and accept handles on various beverage containers, such as coffee mugs, so that a bottom surface of the beverage container with the handle may be completely supported on the first bottom wall 122 and not obstructed by the handle contacting the first sidewall 120. In a particular example, the handle of the beverage container may be supported by a recess and/or a ridge forming a downward protrusion within the partially angled portion of the first sidewall 120. In a more particular example, the recess within the partially angled portion of the first sidewall 120 may form a slot in which the handle may be partially disposed.

In certain embodiments, the second recess 116 may be configured to accept a mobile device. For instance, the second recess 116 may have a second opening 126, a second sidewall 128, and a second bottom wall 130. The second bottom wall 130 may have one or more drain apertures 132 disposed therethrough. The second bottom wall 130 and/or the second opening 126 may be substantially rectangular. Substantially rectangular is defined as have a rectangular shape, including four sides, without requiring a strict adherence to 90 degree angles connecting each side to adjacent sides. Substantially rectangular shapes may encompass quadrilaterals including trapezoids, rhombuses, parallelograms, etc. For example, the second bottom wall 130 and/or the second opening 126 may each have four substantially straight portions. The four substantially straight portions may form two sets of parallel planes. Each set of parallel planes may be formed by a substantially straight portion and a substantially straight portion on the opposing side. In a nonlimiting example, each substantially straight portion may be connected to an adjacent substantially straight portion. The substantially straight portions may be connected by rounded, contoured, or beveled edges. In further examples, the substantially straight portions may not form parallel planes, but still form a substantially rectangular shape. It should be appreciated that the shape of the second bottom wall 130 and/or the second opening 126 may encompass a variety of shapes known to those of skill in the art. In particular examples, the shape of the second bottom wall 130 and the second opening 126 may differ, and form non-corresponding shapes. In a specific, non-limiting example, the second opening 126 may have a third surface area and the second bottom wall 130 may have a fourth surface area. The third surface area of the second opening 126 may be greater than the fourth surface area of the second bottom wall 130. Advantageously, where the third surface area of the second opening 126 is greater than the fourth surface area of the second bottom wall 130, the second recess 116 may be more easily molded and more economically manufactured. Desirably, the mobile device may be more easily disposed into and/or removed from the second recess 116 where the third surface area of the second opening 126 is greater than the fourth surface area of the second bottom wall 130.

In certain embodiments, as shown in FIG. 9, the second recess 116 may be configured to support the mobile device on an angle α. An angled portion of the second sidewall 128 may connect the second bottom wall 130 to the second opening 126. The angle α may be defined by the angled portion of the second sidewall 128 and the plane formed by the armrest on which the second recess 116 is disposed. As shown in FIG. 9, the first armrest 110 may form a plane, where angle α may be formed by the angled portion of the second sidewall 128 on the first armrest 110. Likewise, when the second recess 116 is disposed on the second armrest 112, a similar angle may be formed between the angled portion of the second sidewall 128 and the second armrest 112. Advantageously, the second bottom wall 130 may be substantially offset from the second opening 126, allowing the mobile device to be supported at the angle α and permitting a user seated in the outdoor chair 100 to more readily observe a screen of the mobile device. To that end, the second opening 126 may be substantially offset from second bottom wall 130. As used in this context, "substantially offset" means a normal line, i.e. 90 degree line, formed at a center of the second opening 126 and a center of the second bottom wall 130 are not the same. In other words, the line formed by aligning a center of the second opening 126 to a center of the second bottom wall 130 does not form a 90 degree angle in relation to a plane formed by the second opening 126 or the second bottom wall 130. Essentially, the respective centers of the second opening 126 and second bottom wall 130 are displaced from an alignment of the centers which would form 90 degree angles with the second opening 126 or the second bottom wall 130.

For example, certain embodiments may have the same third surface area and same fourth surface area. The second opening 126 and the second bottom wall 130 may respectively form planes which are parallel to each other. In further embodiments, the second sidewall 128 connecting the second opening 126 to the second bottom wall 130 may be non-orthogonal to one or more of the planes, creating an angle. When viewed from the side, the planes may form the angle α, as illustrated in FIG. 9. In more particular embodiments, portions of the second sidewall 128 connecting the second opening 126 to the second bottom wall 130 may be non-orthogonal to the planes formed by the second opening 126 and/or second bottom wall 130 when viewed from other orientations. It should be appreciated that the size and shape of the second recess 116 may vary. This may change the angle α at various portions of the second sidewall 128 when viewed from different cross sections.

With continued reference to FIG. 9, further examples may retain the angle α even when the second recess 116 is disposed at various orientations. In particular examples, the second recess 116 may be disposed on the first armrest 110 or the second armrest 112 and configured to angle the mobile device toward the center of the backrest 108. More specifically, the angled portion of the second sidewall 128 coplanar with a plane W may be pivoted in relation to the surface of the armrest 110, 112 on which it is disposed, allowing it to retain the angle α. Advantageously, changing the orientation of the second recess 116 may allow for a second recess 116 with greater dimensions, which may accommodate larger mobile devices. Additionally, the orientation of the second recess 116 may be changed. For example, the second recess 116 may be oriented at an angle relative to edges of the armrest 110, 112 on which the second recess 116 is disposed. This can be accomplished while retaining the angle α, further mitigating glare and assisting the user in viewing the mobile device.

With continued reference to FIG. 9, the first recess 114 may include a first depth D1. The first depth D1 may be defined by a distance between the first opening 118 and the first bottom wall 122. As shown in FIG. 9, the first depth D1 may be defined by the distance between X, which corresponds to the first opening 118, and Z, which corresponds to the first bottom wall 122. The first depth D1 may be configured to permit the first recess 114 to support various beverage containers.

In certain embodiments, the second recess 116 may be configured to support the mobile device in an accessible position. To this end, the second recess 116 may include a second depth D2. The second depth D2 may be defined by a distance between the second opening 126 and the second bottom wall 130. As shown in FIG. 9, the second depth D2 may be defined by the distance between X, which corresponds to the second opening 126, and Y, which corresponds to the second bottom wall 130. The second depth D2 may be configured to permit the second recess 116 to support the mobile device from falling while still leaving a majority of the mobile device exposed outside of the second recess 116, thereby permitting the user to access the screen and/or button(s) on the mobile device.

As shown in FIG. 9, the first depth D1 may be greater than D2. In other embodiments, the second depth D2 may be greater than the first depth D1. In certain examples, the first recess 114 may include a taper, allowing the user to fit beverage containers of different sizes in the first recess 114. In other examples, the first recess 114 may have sections which form protrusions in the first sidewall 120, allowing the user to fit beverage containers of different sizes and shapes in the first recess 114. Similarly, the first sidewall 120 may include portions with bevels or inner ridges which can assist in stabilizing and/or accommodating beverage containers of different shapes and sizes. Likewise, certain examples may include a taper in the second recess 116, allowing the user to fit mobile devices of different sizes in the second recess 116. In other examples, the second recess 116 may have sections which form protrusions in the second sidewall 128, allowing the user to fit mobile devices of different sizes and shapes in the second recess 116. Similarly, the second sidewall 128 may include portions with bevels or inner ridges which can assist in stabilizing and/or accommodating mobile devices of different shapes and sizes.

In certain embodiments, the outdoor chair 100 may militate against liquid from collecting in the first recess 114 and/or the second recess 116. For instance, the drain hole 124 of the first bottom wall 122 and the drain aperture 132 of the second bottom wall 130 may be configured to permit liquid to drain therethrough. In a specific example, the drain aperture 132 of the second bottom wall 130 may include multiple drain apertures 132, such as the three drain apertures 132 shown in the figures. Advantageously, where liquid is drained through the drain hole 124 and the drain aperture 132, the beverage container and the mobile device may be placed therein without concern for liquid accumulation, such as rainwater, for example. In a further example, the first bottom wall 122 and the second bottom wall 130 may be angled, directing accumulated condensation and other fluids towards the drain hole 124 or the drain aperture 132.

One or more drain apertures 132 may be sized and shaped to permit a charging cable to be disposed therethrough. It should be appreciated that one or more drain apertures 132 may be sized and shaped in a suitable manner to accommodate various types of charging cables known to those of skill in the art. In further examples, one or more drain apertures 132 may be sized and shaped to permit a charging cable to be disposed therethrough in one orientation while militating against the removal of the charging cable in other orientations. Desirably, a user may charge their mobile device in a supported position in the second recess 116 where one or more drain apertures 132 may be sized and shaped to permit a charging cable to be disposed therethrough. In a specific example, one or more drain apertures 132 may also be sized, shaped, and/or located on the second bottom wall 130 in a manner that would militate against the second bottom wall 130 from obstructing a sound wave emitted from the mobile device, for instance, where the mobile device is playing music or emits an auditory alert as a notification.

Figure 10:
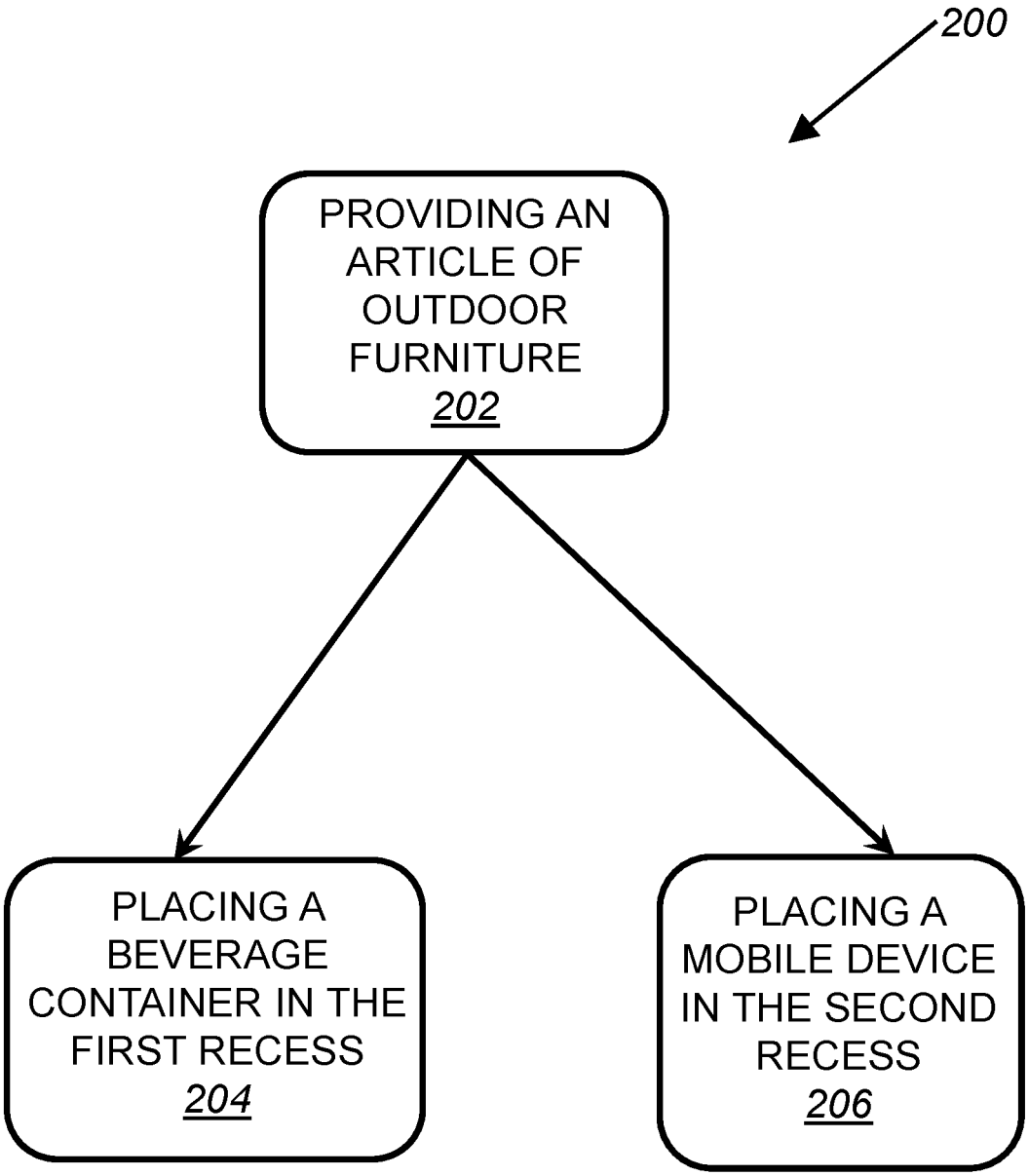
FIG. 10 is a flow chart illustrating a method of using the article of outdoor furniture, according to an embodiment of the present disclosure.

An embodiment of a method 200 of using an outdoor article of outdoor furniture is provided in FIG. 10. The method 200 includes a step 202 of providing an article of outdoor furniture, such as the various embodiments of outdoor furniture as described herein, which may include an outdoor chair 100. The outdoor chair 100 may include a seat 102, a pair of front legs 104, a pair of rear legs 106, a backrest 108, a first armrest 110, a second armrest 112, a first recess 114, and a second recess 116. The first armrest 110 and second armrest 112 may be coupled to the front legs 104 and the backrest 108. Each of the components including the seat 102, a pair of front legs 104, a pair of rear legs 106, a backrest 108, a first armrest 110, a second armrest 112, a first recess 114, and a second recess 116, can be connected to adjacent components, forming a unitary body. The first recess 114 may include a first opening 118, a first sidewall 120, and a first bottom wall 122. The first bottom wall 122 may include a drain hole 124 disposed therethrough. The first bottom wall 122 may have a first surface area. The first opening 118 may have a second surface area. The second surface area of the first opening 118 may be greater than the first surface area of the first bottom wall 122. The first recess 114 may be configured to accept a beverage container. The second recess 116 may have a second opening 126, a second sidewall 128, and a second bottom wall 130. The second bottom wall 130 may have one or more drain apertures 132 disposed therethrough. The second recess 116 may be configured to accept a mobile device, such as a smart phone. The drain hole 124 of the first bottom wall 122 and a drain aperture 132 of the second bottom wall 130 may be configured to permit liquid to drain therethrough. The method 200 may include placing one of a beverage container in the first recess 204 and placing a mobile device in the second recess 206.

Advantageously, the outdoor chair 100 adequately supports hand-held object(s) and may be manufactured more economically and efficiently.

Example embodiments are provided so that this disclosure will be thorough, and will fully convey the scope to those who are skilled in the art. Numerous specific details are set forth such as examples of specific components, devices, and methods, to provide a thorough understanding of embodiments of the present disclosure. It will be apparent to those skilled in the art that specific details need not be employed, that example embodiments may be embodied in many different forms, and that neither should be construed to limit the scope of the disclosure. In some example embodiments, well-known processes, well-known device structures, and well-known technologies are not described in detail. Equivalent changes, modifications and variations of some embodiments, materials, compositions, and methods can be made within the scope of the present technology, with substantially similar results.

What is claimed is:

1. An article of outdoor furniture, comprising:

a unitary body formed of a single piece of material and having a first armrest, a second armrest, a seat, and a backrest;

a first recess formed in the second armrest of the unitary body, the first recess having a first opening and a first bottom wall, wherein a surface area of the first opening is greater than a surface area of the first bottom wall; and a second recess formed in the second armrest of the unitary body, the second recess having a second opening and a second bottom wall, the second opening having a first length and a first width, the first length greater than the first width;

wherein the first recess and the second recess are configured to receive a first recess and second recess of a second identical article of outdoor furniture when a second identical article of outdoor furniture is stacked upon the article of outdoor furniture.

2. The article of outdoor furniture of claim 1, wherein the unitary body includes:

a pair of front legs; and a pair of rear legs.

3. An article of outdoor furniture of claim 1, wherein the first recess is configured to accept a beverage container and the second recess is configured to accept a mobile device.

4. An article of outdoor furniture of claim 1, wherein the first bottom wall is substantially circular.

5. An article of outdoor furniture of claim 1, wherein the first bottom wall includes a drain hole disposed therethrough.

6. An article of outdoor furniture of claim 1, wherein the first recess has a first depth and the second recess has a second depth, the first depth being different than the second depth.

7. An article of outdoor furniture of claim 6, wherein the first depth is greater than the second depth.

8. An article of outdoor furniture of claim 1, wherein the first recess further includes a first sidewall and a portion of the first sidewall connecting the first bottom wall to the first opening is angled relative to a remainder of the first sidewall.

9. An article of outdoor furniture of claim 8, wherein the angled portion of the first sidewall is configured to accommodate a beverage container with a handle, allowing a bottom surface of the beverage container with the handle to be supported by the first bottom wall.

10. The article of outdoor furniture of claim 9, wherein the first sidewall surrounds the entirety of the first bottom wall, and each of the first sidewall and the bottom wall are joined together by a beveled surface, the beveled surface configured to direct liquid towards a drain hole, and to prevent obstruction of the handle of the beverage container by the first sidewall.

11. An article of outdoor furniture of claim 1, wherein the second opening is substantially rectangular.

12. An article of outdoor furniture of claim 1, wherein the second bottom wall is substantially rectangular.

13. An article of outdoor furniture of claim 1, wherein the second bottom wall has a drain aperture disposed therethrough.

14. An article of outdoor furniture of claim 1, wherein the second opening has a third surface area and the second bottom wall has a fourth surface area wherein the third surface area is greater than the fourth surface area.

15. An article of outdoor furniture of claim 14, wherein the second bottom wall is substantially offset from the second opening and a portion of a second sidewall connecting the second bottom wall to the second opening is angled relative to a remainder of the second sidewall.

16. An article of outdoor furniture of claim 15, wherein the second recess is configured to support a mobile device at an angle formed by the second sidewall relative to a plane formed by the armrest on which the second recess is disposed, the angle permitting a user seated in the article of outdoor furniture to visibly observe a screen of the mobile device.

17. An article of outdoor furniture, comprising:

a unitary body formed of a single piece of material including:

a first armrest;

a second armrest;

a seat;

a backrest;

a pair of front legs; and a pair of rear legs;

a first recess formed in the second armrest of the unitary body, the first recess having a first opening and a first bottom wall, a surface area of the first opening greater than a surface area of the first bottom wall, the first recess configured to accept a beverage container, the first bottom wall being substantially circular, the first bottom wall including a drain hole disposed therethrough, the first recess including a first sidewall and a portion of the first sidewall connecting the first bottom wall to the first opening is partially angled, and the partially angled portion of the first sidewall configured to accommodate a beverage container with a handle, thereby allowing a bottom surface of the beverage container with the handle to be supported by the first bottom wall; and a second recess formed in the second armrest of the unitary body, the second recess having a second opening and a second bottom wall, the second opening having a first length and a first width, the first length greater than the first width, the second opening and the second bottom wall being substantially rectangular, the second bottom wall having a drain aperture disposed therethrough, the drain aperture including a plurality of drain apertures, the second opening having a third surface area and the second bottom wall having a fourth surface area with the third surface area being greater than the fourth surface area, the second bottom wall being substantially offset from the second opening, and a portion of the second sidewall connecting the second bottom wall to the second opening being partially angled;

wherein the first recess and the second recess are configured to receive a first recess and second recess of a second identical article of outdoor furniture when a second identical article of outdoor furniture is stacked upon the article of outdoor furniture;

wherein the second recess is configured to accept a mobile device, the second recess being configured to support the mobile device at an angle formed by the second sidewall and a plane formed by the armrest on which the second recess is disposed, the angle permitting a user seated in the article of outdoor furniture to visibly observe a screen of the mobile device.

18. A method of using an article of outdoor furniture, comprising:

providing an article of outdoor furniture including:

a unitary body formed of a single piece of material and having a first armrest, a second armrest, a seat, and a backrest;

a first recess formed in the first armrest of the unitary body, the first recess having a first opening and a first bottom wall, wherein a surface area of the first opening is greater than a surface area of the first bottom wall; and a second recess formed in the first armrest of the unitary body, the second recess having a second opening and a second bottom wall, the second opening having a first length and a first width, the first length greater than the first width;

wherein the first recess and the second recess are configured to receive a first recess and second recess of a second identical article of outdoor furniture when a second identical article of outdoor furniture is stacked upon the article of outdoor furniture; and placing one of a beverage container in the first recess and a mobile device in the second recess.

* * * * *